United States Patent [19]

Hinrichs

[11] 4,126,184

[45] Nov. 21, 1978

[54] INSTANTANEOUS RELEASE, DUAL VALVE FOR FIRE SUPPRESSION APPARATUS

[75] Inventor: James O. Hinrichs, Odessa, Mo.

[73] Assignee: Fike Metal Products Corporation, Blue Springs, Mo.

[21] Appl. No.: 745,003

[22] Filed: Nov. 26, 1976

[51] Int. Cl.[2] ..... A62C 35/08

[52] U.S. Cl. ..... 169/56; 137/68 R; 169/28; 220/261

[58] Field of Search ..... 169/26, 28, 56; 220/89 A, 261; 137/68

[56] References Cited

U.S. PATENT DOCUMENTS

| | | | |
|---|---|---|---|
| 2,580,365 | 12/1951 | Simmonds | 220/89 A |
| 2,742,094 | 4/1956 | Mathisen | 169/28 |
| 2,766,832 | 10/1956 | Mathisen | 169/28 X |
| 3,092,286 | 6/1963 | Duff | 220/261 |
| 3,604,511 | 9/1971 | Griffith et al. | 169/28 |
| 3,722,734 | 3/1973 | Raidl, Jr. | 220/89 A |

*Primary Examiner*—Joseph F. Peters, Jr.
*Assistant Examiner*—Michael Mar
*Attorney, Agent, or Firm*—Schmidt, Johnson, Hovey & Williams

[57] ABSTRACT

An instantaneously actuatable, field-serviceable valve unit for pressurized fire suppression systems which allows extremely fast, essentially uninterrupted flow of extinguishant upon operation thereof and is constructed for permitting easy recharging and periodic servicing of the system in the field. The unit includes an elongated flow tube connected to a supply of extinguishant and having a pair of removably mounted rupture discs respectively located across the end of the tube and received in an aperture through the sidewall thereof, so that both discs experience the pressure of the extinguishant; a detonator is removably installed outside of the tube adjacent the sidewall-mounted disc for ready replacement thereof in the field, and is electrically actuatable in response to combustion conditions to explode and create a pressure sufficient to instantaneously burst the discs so that the pressurized extinguishant is released and allowed to flow uninterruptedly for quickly suppressing a fire. The removability of the discs, and the use of a filling valve located in the flow tube, allows the system to be recharged with extinguishant and rearmed without the necessity of factory servicing. The use of a nonfragmenting main disc for confining the fire suppression fluid assures safe operation by preventive discharge of projectiles into the protected space upon operation of the apparatus.

11 Claims, 7 Drawing Figures

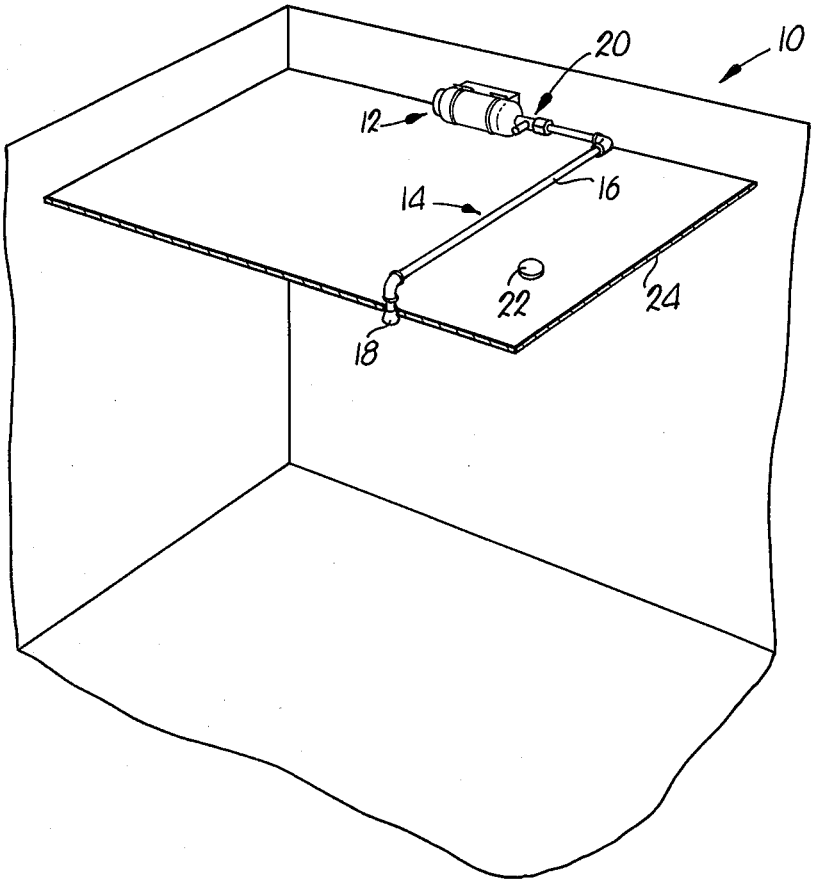
Fig. 1.
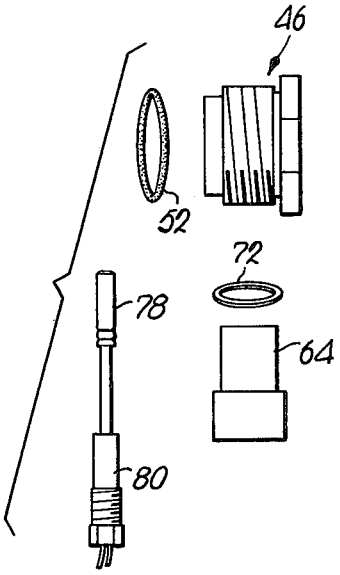
Fig. 7.
Fig. 2.
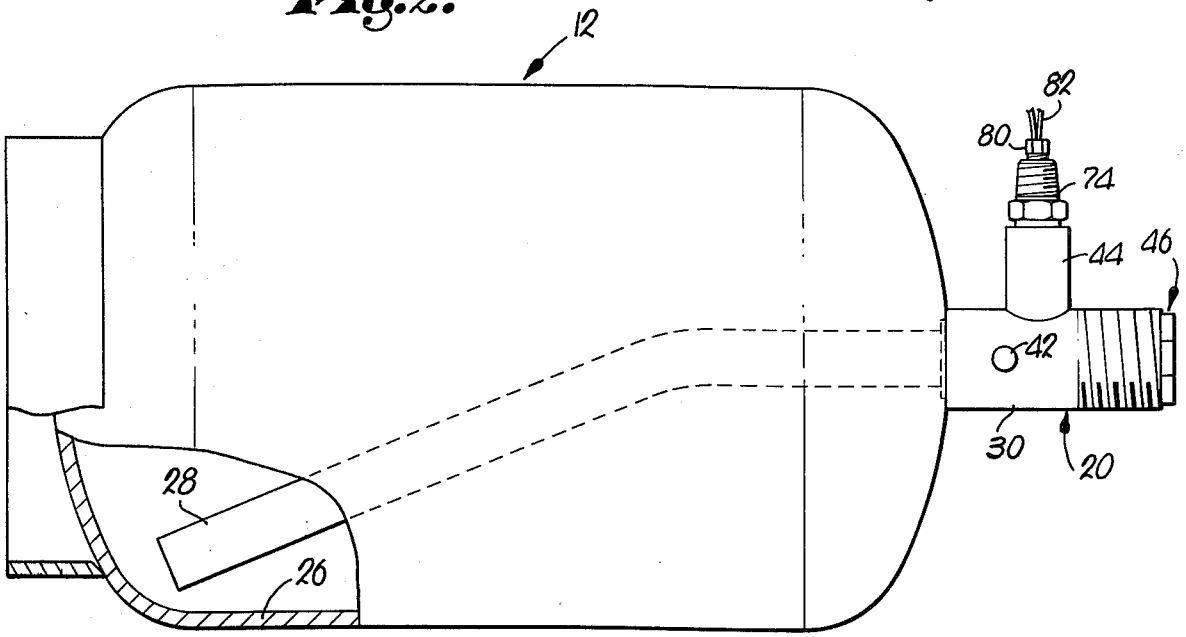

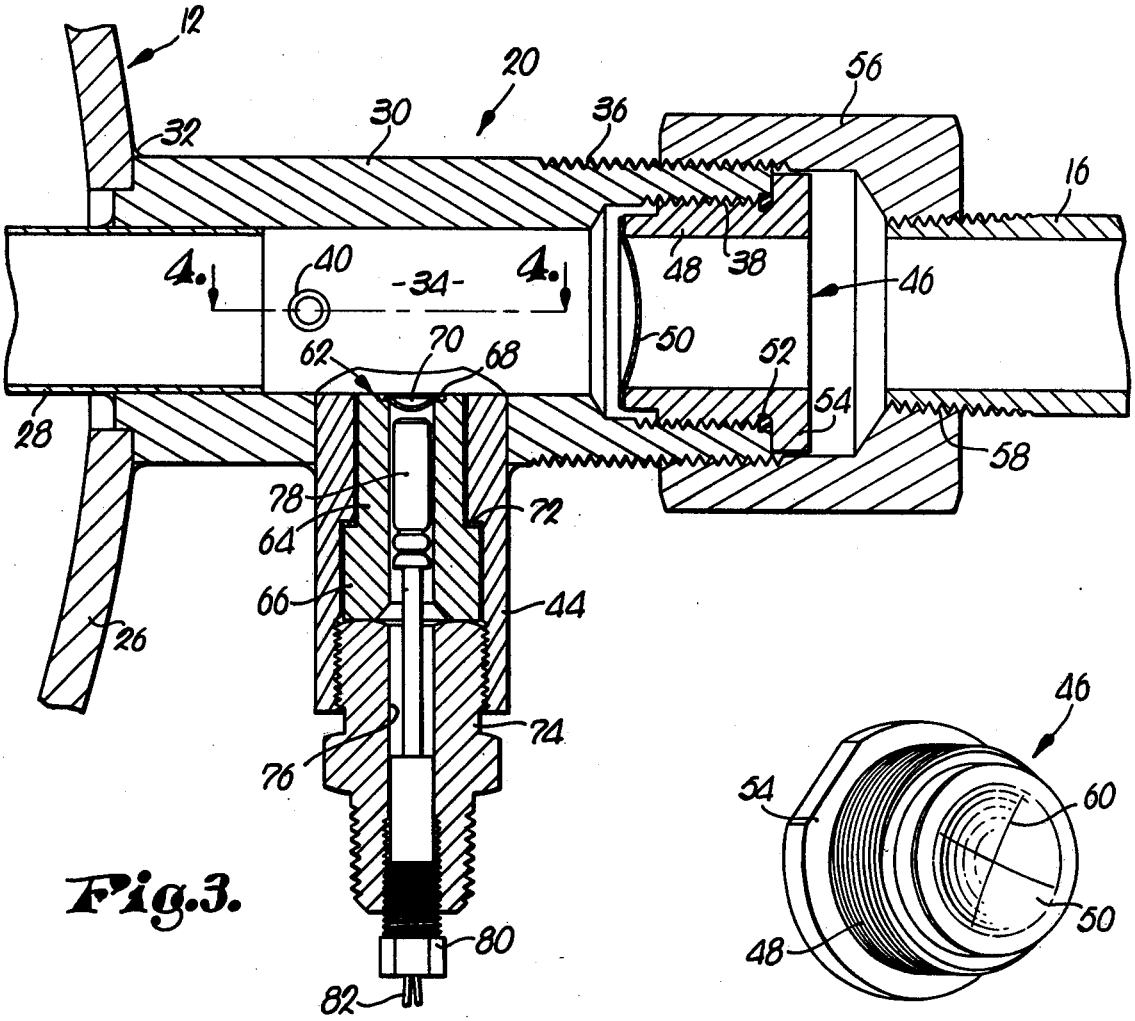
Fig.3.
Fig.5.
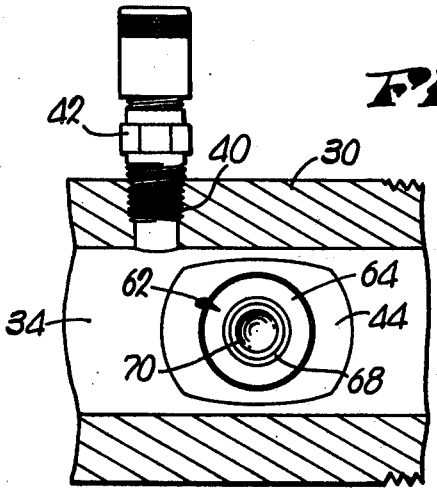
Fig.4.
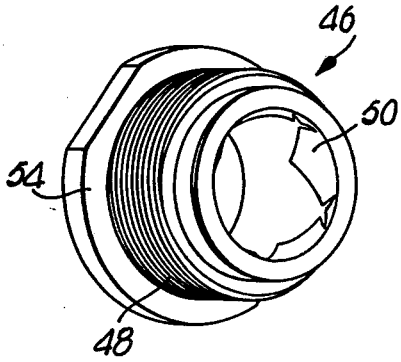
Fig.6.

INSTANTANEOUS RELEASE, DUAL VALVE FOR FIRE SUPPRESSION APPARATUS

This invention relates to apparatus for releasing a hazard-suppressing substance from a pressurized supply thereof in response to conditions indicating the presence of a hazard such as fire. More particularly, it is concerned with apparatus which is essentially instantaneously actuatable and allows for substantially uninterrupted flow of hazard-suppressing substance so that a fire or the like may be quickly suppressed before it becomes a major conflagration. A particular feature of the invention resides in the use of a pair of rupture discs and an externally mounted detonator which are arranged so that the unit can be quickly and easily serviced in the field either on a regular basis or after actuation of the unit.

In recent years, there has been a tremendous increase in the use of electrically controlled, high speed fire suppression systems. Such units may be used to protect certain key rooms or areas in buildings, or as a general safety measure. For example, this type of system may be used to protect rooms housing computer equipment, bank and fur vaults and control centers, or in high hazard areas such as paint booths or laboratories. In general, these systems include a supply of a fire suppressant such as bromotrifluoromethane under pressure, along with a distribution system normally located in the ceiling of the area to be protected. Instantaneously actuatable valving apparatus is normally provided with the supply of pressurized extinguishant, and the valve unit is conventionally provided with rupturable disc structure which normally seals the vessel holding the extinguishant. An explosive detonator is commonly provided adjacent the rupturable disc structure and is coupled to sensing means located in the area to be protected. When conditions indicating the presence of a fire are sensed, the detonator is electrically exploded, thus rupturing the pressure disc structure and allowing the pressurized extinguishant to quickly flow from the supply vessel and into the room to extinguish the fire before it becomes a major conflagration.

A number of fire suppression systems of the type described above have been proposed in the past. For example, U.S. Pat. No. 3,762,479 describes a remotely actuatable fire suppression system which is especially adapted for marine or aircraft use. Other patents of interest in this connection include U.S. Pat. Nos. 3,552,495, 1,708,869, 2,436,364, 3,088,478 and 3,515,217.

Although certain of the fire suppression systems heretofore available have received widespread commercial success, a number of problems remain. First of all, in many instances all or part of the detonating means employed therein is disposed in the flow path of the substance. Thus, upon actuation of the detonating device to rupture the associated disc, interference to flow is sometimes presented. This is of course objectionable in that flow interruption inevitably tends to slow the effective response of the system to hazard conditions. Moreover, in those instances where the detonator structure is disposed outside of the extinguishant flow tube, actuation thereof and consequent disc rupturing is normally in opposition to the normal internal pressure of the extinguishant vessel and system, and this tends to further slow response.

Another objection to conventional systems results from the fact that they are very difficult if not impossible to service in the field. In this regard, buildings equipped with modern-day fire suppression apparatus generally are considered to be favorable insurance risks, and therefore fire insurance premiums and the like are relatively low. However, these favorable insurance rates can be lost if the system is not periodically inspected and serviced. For example, many insurors require that the system detonators be replaced periodically and the overall system fully inspected for leaks and the like. In addition, many insurors stipulate that the protective system cannot be rendered inoperative for a period exceeding 24 hours. Hence, a system which can be periodically serviced or even completely recharged after actuation without the necessity of disassembling the extinguishant vessel and valving structure and sending the same for factory servicing is highly advantageous. However, most prior units include rupture discs which are soldered in place and can be filled with extinguishant only at the factory; therefore, the economic advantages of these systems in terms of insurance premium reduction are sometimes lost by virtue of the fact that they cannot be adequately serviced in the field.

Another drawback of conventional fire suppression systems stems from the fact that they lack good design flexibility. That is, a prime use for fire suppression systems is in existing structures, and in order to be feasible a fire suppression system must be installable at various locations where space permits in an existing structure. Thus, while a given system may be very adequate if it is planned for and installed during original construction of a building, it may be totally unworkable because of design problems when applied to an existing building.

It is therefore the most important object of the present invention to provide a fire suppression system which includes valving mechanism which is essentially instantaneously actuatable in response to the existence of conditions indicating a hazard such as fire, and which allows extremely rapid application of a hazard-suppressing substance by providing a flow path for the latter which is free of interruptions or flow restrictions.

Another object of the invention is to provide a hazard-suppressing system wherein the valve unit associated therewith can be quickly and easily serviced in the field without the need for disassembling the unit for factory servicing; this field serviceability applies not only to periodic inspections and scheduled replacements of the unit detonator, but also to servicing the system in the event that it actuates to suppress a hazard and requires complete recharging and rearming.

As a corollary to the foregoing, another object of the invention is to provide a dual disc valve apparatus which includes an elongated flow tube connected between a pressurized supply of extinguishant and distribution means therefor, and a pair of removably mounted rupture discs respectively located across the end of the tube and received in an aperture through the sidewall thereof; a detonator is removably mounted outside of the tube adjacent the sidewall-mounted disc and is electrically actuatable in response to the existence of hazardous conditions to explode and substantially instantaneously rupture both of the discs in order to present an essentially obstruction-free flow path for the extinguishant. Since the suppressant fluid confining disc is of the nonfragmenting nature, no flying projectile danger is presented by operation of the apparatus to effect instantaneous release of the suppressant fluid.

A still further object of the invention is to provide a valve unit of the type described which includes a pair of removably mounted rupture discs, a removable detonator adjacent the sidewall mounted disc, and a filling valve located in the flow tube adjacent the extinguishant vessel; provision of this structure allows the detonator to be replaced as needed at regular intervals, and also permits the vessel to be recharged with extinguishant, refitted with new discs, and rearmed after the unit actuates to suppress a fire.

In the drawings:

FIG. 1 is a somewhat schematic, perspective view of a fire suppression system in accordance with the invention, shown mounted above the ceiling of a protected room and ready for actuation;

FIG. 2 is an enlarged view with parts broken away for clarity of the extinguishant vessel used in the present invention;

FIG. 3 is a fragmentary, vertical sectional view illustrating the detail of the dual disc valve unit of the invention;

FIG. 4 is a sectional view taken along line 4—4 of FIG. 3 and further depicting the filling valve and sidewall-mounted rupture disc provided with the overall valve unit;

FIG. 5 is a perspective view of the end-mounted removable rupture disc assembly shown prior to actuation thereof;

FIG. 6 is a perspective view similar to FIG. 5 but illustrating the nonfragmenting operation of the rupture disc; and FIG. 7 is a composite view of the removable elements of the overall valve unit which must be replaced upon actuation of the system.

Referring now to the drawings, a fire suppression system 10 is illustrated in FIG. 1 and broadly includes a metallic vessel 12 adapted to hold a supply of extinguishant under pressure, distribution means 14 in the form of appropriate piping structure 16 and nozzle 18, and dual disc valve apparatus broadly referred to by the numeral 20. Sensing means 22 also forms a part of system 10 and in practice can be any one of a number of conventional devices operable to sense the existence of conditions indicating a hazard such as fire. The sensing means can be any one of a number of types of detection devices or systems which complete an electrical circuit for hazard detection, for example temperature, smoke, infrared, ionization, ultraviolet or pressure sensors.

Although system 10 is illustrated in FIG. 1 as being mounted above the ceiling 24 of a room to be protected, it is to be understood that the invention is not so limited. In fact, as will be clear from the following description, vessel 12 and the associated valving apparatus can be mounted between walls or under floors to good effect, and in general in any area of an existing or planned construction having sufficient space to accommodate these items. However disposed, system 10 is operable, upon sensing the conditions indicative of a hazard to quickly spread an extinguishant over the area to be protected, so that the fire or the like is held to minor proportions.

In more detail, vessel 12 is of essentially conventional construction and comprises a thick-walled metallic body 26 of sufficient volume to hold an adequate supply of extinguishant. The vessel is normally extremely resistant to pressure buildup, and generally can withstand pressures on the order of 1,000 p.s.i. or greater, so that catastrophic explosions of the vessel are avoided. For purposes of illustration only as to a typical installation, vessel 12 is shown as being oriented with longitudinal axis thereof horizontal. In this bottle position it is desirable that the vessel be provided with an internal siphon tube 28 as depicted in FIG. 2. Tube 28 should also be provided for vertical installation where the release valve extends upwardly. However, the siphon tube may normally be eliminated for vertically oriented, downward facing valve dispositions. Tube 28 facilitates extremely rapid dumping of liquid extinguishant from vessel 12 by allowing creation of a siphon effect therewithin.

Valve apparatus 20 includes an elongated metallic tube 30 which receives the outwardly extending end of siphon tube 28 and is gusset welded to body 26 as at 32. Tube 30 defines a substance-conveying passageway 34 which in effect communicates the interior of vessel 12 and piping structure 16. The outermost end of tube 30 is threaded both externally and internally as at 36 and 38, and is provided with a threaded aperture 40 which is adapted to receive a conventional filling valve 42. Finally, an annular, radially extending, internally threaded extension 44 is welded to tube 30 intermediate the ends thereof and extends through an aperture in the latter to communicate with passage 34.

First frangible diaphragm and support means 46 is removably mounted adjacent the outermost end of tube 30. As best shown in FIG. 3, diaphragm and support means 46 is located across passageway 34 and includes an annular, externally threaded body 48 which is complementally received by the internal threads 38 of tube 30. A concavo-convex rupture disc 50 is secured across the innermost end of body 48, such that the convex face thereof experiences the normal pressure within passageway 34. A conventional sealing gasket 52 is interposed between the radially expanded lip portion 54 of body 48 and the outermost internal edge of tube 30 in order to provide an adequate seal.

As best shown in FIG. 3, diaphragm means 46 is simply threaded into tube 30 and sealed by means of gasket 52. In order to further enhance the integrity of the seal, an appropriately configured and threaded annular collar 56 is disposed about diaphragm means 46 and is threadably coupled to the threads 36 of tube 30. The outermost end of collar 56 is internally threaded as at 58, in order to receive a complementally threaded end of piping structure 16. Thus, it will be appreciated that a substance flow path is defined by siphon tube 28, tube 30, body 48 and piping structure 16; this flow path is normally blocked by rupture disc 50 so that flow of pressurized extinguishant from vessel 12 is prevented until the disc is ruptured.

In preferred forms, disc 50 is provided with appropriate scoring 60 so that lines of weakness are defined in the disc. As is well known in this art, such lines of weakness will cause disc 50 to rupture along the predetermined lines and substantially prevent fragmenting of the disc. The operation of disc 50 is illustrated comparatively in FIGS. 5 and 6. In FIG. 5 the disc is shown prior to actuation thereof, while in FIG. 6 the sections of "petals" of the disc are shown folded back against the internal walls of body 48. The presence of the score lines 60 prevents creation of fragments or the like which can block or restrict flow of extinguishant through system 10. Moreover, by virtue of the fact that disc 50 is placed so that the concave face thereof communicates with passageway 34, outward bursting of the disc is facilitated without creating any flow restrictions.

Second frangible diaphragm means 62 is disposed within extension 44 in communication with passage 34 and includes an elongated, annular, tube-like element 64 having a radially expanded outermost end 66 and a foreward end which is relieved as at 68. A relatively small, metallic concavo-convex rupture disc 70 is seated and secured within the relieved portion 68 in disposition for preventing flow of material from passageway 34 into the interior bore of element 64. As best seen in FIG. 3, a conventional gasket 72 is interposed between the innermost radial face of end 66 and the complementally configured radial portion of extension 44, in order to provide an adequate seal. The disc 70 is preferably located so that the convex face thereof experiences rupturing pressure from the rupturing means described hereinafter.

A threaded coupler 74 is received within the internally threaded, outermost end of extension 44 in a manner to abut the outermost end of element 64 and compress the gasket 72. Coupler 74 includes an axially extending bore 76 which is threaded as at 78. The bore 76 is adapted to receive a conventional explosive detonator 78, and the latter is secured in place by means of a threaded, axially bored member 80. Detonator 78 includes connection wire 82 which allow the same to be electrically connected in a sensing circuit along with sensing means 22 described previously. The detonator is adapted to explode upon receiving an electrical signal, in order to actuate system 10. It is to be noted that detonator 78 is spaced from disc 70 within the bores of element 64 and coupler 74. Although the detonator could be configured to abut the disc if desired, the spacing allows a used element 64 to be cleaned out and remachined as may be necessary for refitting with a new disc 70, so that servicing costs are reduced.

In use when system 10 is installed in a room or area to be protected, the existence of conditions indicating a fire or other hazard is first sensed by the appropriate sensing means 22 which, in conjunction with the remainder of the conventional sensing circuit (not shown) delivers an electrical signal to detonator 78. This causes the detonator to explode within the aligned bores of coupler 74 and element 64, in order to substantially instantaneously create a pressure sufficient to rupture the discs 70 and 50. In this regard, the normal pressure within vessel 12 and passageway 34 is generally on the order of 200 p.s.i., while the burst pressures of the respective discs 70 and 50 is substantially greater. However, detonator 78 is operable to create a pressure of a magnitude to instantaneously burst both of the discs. Although this bursting occurs on a sequential basis with disc 70 bursting prior to disc 50, it will be appreciated that the relatively large pressures created by the explosion of detonator 78 causes both of the discs to burst within a period of a fraction of a second. In any event, bursting of the discs 70 and 50 creates a substantially unrestricted and uninterrupted flow path for the material within vessel 12, so that the latter is quickly moved by virtue of the pressure thereof through passageway 34 and distribution means 16 for application to the room or area being protected.

A prime feature of the present invention resides in the field serviceability thereof. For example, when it is necessary to replace the detonator 78 because of safety regulations, it is only necessary to unscrew the element 80 from the coupler 74, and remove the old detonator, whereupon a fresh detonator can be installed in its place. Note in this regard that it is not necessary to disturb vessel 12 or in any way alter the pressure level thereof.

This same serviceability is maintained even in the event that system 10 actuates. In this case the discs 70 and 50 need replacement along with detonator 78, and vessel 12 needs to be recharged with extinguishant. The procedure to be followed in this instance involves first detaching pipe structure 16 and collar 56, whereupon diaphragm means 46 can be removed. New diaphragm means having an intact disc 50 is then installed using a fresh gasket 52, whereupon the collar and piping structure are reconnected. The next step involves detaching coupler 74 and removing the disc-supporting element 64 from extension 44. A new element 64 having an intact disc 70 is then placed within extension 44 using a fresh gasket 72, and coupler 74 is replaced. The device is next rearmed by installing a new detonator in the manner specified above. The final step in the process involves opening the conventional valve 42 and refilling vessel 12 with a desired extinguishant up to the design pressure. This is possible since the respective discs 70 and 50 are again provided in pressure sealing relationship to the tube 34. At this point, system 10 is again ready for use without any necessity for factory servicing thereof. The parts necessary for complete servicing of system 10 are shown in FIG. 7.

Although a wide variety of extinguishants can be used in connection with the present invention, the preferred substance is sold by E. I. Dupont DeNemours Company and others under the designation Halon 1301, which is bromotrifluoromethane. This extinguishant has proven to be extremely efficient in suppressing fires and for this reason is preferred. During normal pressurized storage within vessel 12 this material is a liquid, but becomes a gas upon application thereof.

Having thus described the invention, what is claimed as new and desired to be secured by Letters Patent is:

1. Apparatus for releasing a hazard-suppressing substance in response to conditions indicating the presence of a hazard, said apparatus comprising:

a vessel for holding a supply of said substance under pressure;

a substantially straight, substance-coveying tubular member which defines a substantially unobstructed substance-conveying passageway secured to said vessel and in open communication with the interior of the latter, said member having an aperture through a sidewall thereof;

means for normally closing said member against fluid flow therefrom, including first frangible diaphragm means disposed across said member and in spaced relationship to said vessel with said aperture between the latter and the first diaphragm means, and a second frangible diaphgram means located adjacent said aperture, said first diaphragm means being the sole flow-blocking member disposed across said member and being operable for rupturing upon experiencing a significant increase in pressure within said tubular member, said second diaphgram means being operable for rupturing upon experiencing a significant increase in pressure directed against the face thereof remote from said passageway;

a supply of said hazard-suppressing substance under pressure and located within said vessel and tubular member and bearing directly against said first and second frangible diaphragm members;

rupture means adapted for connection to sensing means operable to sense the existence of hazard-indicating conditions;

structure removably mounting said rupture means completely outside of said tubular member and adjacent said second diaphragm means for allowing replacement of said rupture means without draining of said vessel and tubular member of said substance or altering the pressure conditions within the same, said rupture means including structure for creating, upon receiving a signal from said sensing means, pressure conditions against the face of said second diaphragm means remote from said passageway sufficient for rupturing said second diaphragm means with any diaphragm fragments resulting from said rupturing being directed generally transverse relative to the longitudinal axis of said tubular means, and for creating pressure conditions within said tubular member, after said second diaphragm means has ruptured, for rupturing said first diaphragm means, such that said substance can then unrestrictedly flow out of said vessel and tubular member.

2. Apparatus as set forth in claim 1 wherein said first diaphragm means comprises a concavo-convex disc having the concave face thereof located for experiencing the rupturing pressure created by said rupture means.

3. Apparatus as set forth in claim 2 wherein said disc is scored for allowing the disc to rupture without fragmentation thereof.

4. Apparatus as set forth in claim 1 wherein said second diaphragm means comprises a concavo-convex disc having the convex face thereof located for experiencing the rupturing pressure created by said rupture means.

5. Apparatus as set forth in claim 4 wherein said disc is smaller than said first diaphragm means.

6. Apparatus as set forth in claim 1 including a filling valve mounted in a wall of said passageway-defining structure for replenishing said supply of substance.

7. Apparatus as set forth in claim 1 wherein said mounting structure includes means for removably mounting said second diaphgram means and said rupture means in place.

8. Apparatus as set forth in claim 1 including means removably mounting said first diaphragm means in place.

9. Apparatus as set forth in claim 1 wherein said rupture means comprises an electrically actuated detonator.

10. Apparatus as set forth in claim 9 wherein said detonator is located in spaced relationship to said second diaphragm means.

11. Apparatus as set forth in claim 1 wherein said substance includes a fire extinguishant.

* * * * *